US008078405B2

(12) United States Patent
Delorme et al.

(10) Patent No.: US 8,078,405 B2
(45) Date of Patent: Dec. 13, 2011

(54) METHOD OF ESTIMATING THE PERMEABILITY OF A FRACTURE NETWORK FROM A CONNECTIVITY ANALYSIS

(75) Inventors: Matthieu Delorme, Rueil-Malmaison (FR); Bernard Bourbiaux, Rueil-Malmaison (FR)

(73) Assignee: IFP, Cedex (FR)

( * ) Notice: Subject to any disclaimer, the term of this patent is extended or adjusted under 35 U.S.C. 154(b) by 477 days.

(21) Appl. No.: 12/146,832

(22) Filed: Jun. 26, 2008

(65) Prior Publication Data

US 2009/0005996 A1 Jan. 1, 2009

(30) Foreign Application Priority Data

Jun. 29, 2007 (FR) ..... 07 04703

(51) Int. Cl.
*G01V 5/04* (2006.01)

(52) U.S. Cl. ..... 702/12; 702/11; 702/13; 702/14

(58) Field of Classification Search ..... 702/11–14; 703/2, 10

See application file for complete search history.

(56) References Cited

U.S. PATENT DOCUMENTS

| | | | | |
|---|---|---|---|---|
| 5,757,663 | A * | 5/1998 | Lo et al. | 702/6 |
| 6,023,656 | A | 2/2000 | Cacas et al. | |
| 7,584,086 | B2 * | 9/2009 | Frankel | 703/10 |
| 2006/0282243 | A1 * | 12/2006 | Childs et al. | 703/10 |

FOREIGN PATENT DOCUMENTS

FR 2 757 947 7/1998

OTHER PUBLICATIONS

Philip et al., 'Modeling Coupled Fracture-Matrix Fluid Flow in Geochemically Simulated Fracture Networks', 2005, SPE Publication, pp. 300-309.*

Sait I. Ozkaya and Joerg Mattner: "Fracture Connectivity from Fracture Intersections in Borehole Image Logs", Computers & Geosciences, No. 29, 2003, pp. 143-153, XP002472550.

Macé Laetitia et al, "3d Fracture Modeling Integrating Geomechanics and Geologic Data", AAPG International Conference, Oct. 24, 2004, pp. 1-6, XP002472551 Cancun.

Li Liyong et al: "Efficient Field-Scale Simulation of Black Oil in a Naturally Fractured Reservoir via Discrete Fracture Networks and Homogenized Media", Society of Petroleum Engineers, vol. SPE, No. 103901, Dec. 5, 2006—Dec. 7, 2006, pp. 1-12, XP002472552 Beijing.

(Continued)

*Primary Examiner* — Michael Nghiem
*Assistant Examiner* — Elias Desta
(74) *Attorney, Agent, or Firm* — Antonelli, Terry, Stout & Kraus, LLP.

(57) ABSTRACT

A method for optimizing the development of a fractured hydrocarbon reservoir wherein the network permeability is determined using a reliable compromise between numerical and analytical methods which has application to oil reservoir development. The reservoir is discretized into a set of grid cells and a geometrical description of the fracture network in each cell is elaborated. A connectivity index is then deduced within each cell for the fractures. The permeability of the fracture network of the cells whose connectivity index is above a first threshold is determined and a zero permeability value is assigned in the other cells. Other thresholds can be determined so as to choose between a numerical method and an analytical method to determine the permeability. These permeabilities are exploited in a flow simulator so as to optimize the development of the reservoir.

16 Claims, 2 Drawing Sheets

OTHER PUBLICATIONS

M. Mashihi et al: "Fast Estimation of Performance Parameters in Fractured Reservoirs Using Percolation Theory", Society of Petroleum Engineers, vol. SPE, No. 94186, Jun. 13, 2005—Jun. 16, 2005, pp. 1-12, XP0024725553 Madrid.

R. Basquet, et al: "Fracture Flow Property Identification: An Optimized Implementation of Discrete Fracture Network Models", Society of Petroleum Engineers, vol. SPE, No. 93748, Mar. 12, 2005—Mar. 15, 2005 pp. 1-9, XP002472554, Bahrain.

* cited by examiner

METHOD OF ESTIMATING THE PERMEABILITY OF A FRACTURE NETWORK FROM A CONNECTIVITY ANALYSIS

BACKGROUND OF THE INVENTION

1. Field of the Invention

The present invention relates to the field of optimization of the development of underground reservoirs such as hydrocarbon reservoirs, notably those comprising a fracture network.

2. Description of the Prior Art

The petroleum industry, and more precisely petroleum reservoir exploration and development, requires knowledge of the underground geology as perfectly as possible to efficiently provide evaluation of reserves, production modelling or development management. In fact, determining the location of a production well or of an injection well, the drilling mud composition, the completion characteristics, the parameters required for optimum hydrocarbon recovery (such as injection pressure, production flow rate, etc.) requires good knowledge of the reservoir. Reservoir knowledge means knowledge of the petrophysical properties of the subsoil at any point in space.

The petroleum industry has therefore combined for a long time technical measurements with modelling performed in the laboratory and/or by softwares. Petroleum reservoir modelling thus is an essential technical stage with a view to reservoir exploration or development. The goal of modelling is to provide a description of the reservoir.

Engineers in charge of the development of fractured reservoirs need to perfectly know the role of fractures. What is referred to as fracture is a plane discontinuity of very small thickness in relation to the extent thereof, representing a rupture plane of a rock of the reservoir.

On the one hand, knowledge of the distribution and of the behavior of these fractures allows optimizing the location and the spacing between wells to be drilled through the oil-bearing reservoir.

On the other hand, the geometry of the fracture network conditions the fluid displacement, at the reservoir scale as well as the local scale where it determines elementary matrix blocks in which the oil is trapped. Knowing the distribution of the fractures is therefore also very helpful, at this stage, to the reservoir engineer who wants to calibrate the models he or she constructs to simulate the reservoirs in order to reproduce or to predict the past or future production curves.

Engineers in charge of the development of fractured reservoirs therefore need to estimate the large-scale permeability (scale of the drainage radius of a well or of the interwell space for example) of the fracture networks and to forecast the hydrodynamic behavior (flow rate, pressure, etc.) of these networks in response to exterior stresses imposed via wells.

Geosciences specialists therefore first carry out characterization of the fracture network in form of a set of fracture families characterized by geometrical attributes.

Then, with a view to simulation of the flows within the fractured reservoir, a numerical model is used most often. This model is applied to a discretized representation of the reservoir, that is the reservoir is divided into a set of grid cells. Application of the numerical model requires knowledge of the flow properties of the fracture network at the cell scale, usually of hectometric size. In particular, the permeabilities of the fracture network have to be determined.

This can be reliably achieved from a flow calculation carried out on a geometrical model representative of the fracture network. Such a method is described in French Patent 2,757,947 and corresponding U.S. Pat. No. 6,023,656.

However, this numerical calculation method is costly in calculating time for complex and/or large-size reservoirs. Discretization of a reservoir often leads to the construction of a grid comprising millions of cells.

The specialist then has alternative methods available, in fact analytical calculation methods. What is referred to as analytical method is one or more equations allowing precise determination, without approximations or numerical (iterative, etc.) techniques, the unknowns of a problem according to the data. An analytical method example is for instance described in the following document:

M. Chen, M. Bai and J.-C. Roegiers, Permeability Tensors of Anisotropic Fracture Networks, Mathematical Geology, Vol. 31, No. 4, 1999.

However, analytical methods are most often based on hypotheses simplifying the physical problem and these methods do not allow obtaining the accuracy reached by the numerical methods that allow the real complexity of physics to be fully taken into account. It is however sometimes crucial to preserve a high accuracy in the permeability estimation of fracture networks so as to be able to select the best production scenarios allowing the hydrocarbon production to be optimized.

The invention is a method for optimizing the development of a hydrocarbon reservoir comprising a fracture network, wherein the network permeability is determined by means of a reliable compromise between numerical and analytical methods.

The method achieves this by carrying out a quantitative analysis of the connectivity properties of the fracture network, so as to limit the use of numerical methods.

SUMMARY OF THE INVENTION

The method according to the invention is notably suited for the study of hydraulic properties of fractured formations, notably the study of hydrocarbon displacements in underground reservoirs.

In particular, the invention relates to a method for determining the permeability of a fracture network so as to predict fluid flows likely to occur through the reservoir. Hydrocarbon production can then be simulated according to various production scenarios.

The invention relates to a method for optimizing the development of a reservoir comprising a fracture network, wherein the reservoir is discretized into a set of grid cells. A geometrical description of the fracture network in each cell is also elaborated. The method comprises the following stages:

determining, within each cell, a connectivity index depending at least on the number of intersections between fractures, by means of the geometrical description;

estimating the permeability of the fracture network of cells whose connectivity index is above a threshold;

assigning a fixed permeability value within the other cells whose connectivity index is below the threshold, so as to limit the number of permeability estimations; and optimizing the reservoir development, by simulating fluid flows in the reservoir, as a function of the permeabilities of the fracture network in each cell.

In order to further optimize the estimation of the fracture network permeability in each cell, it is possible to select, for each cell, a method of estimating the fracture network permeability as a function of the value of the connectivity index.

The method can be selected by defining two connectivity thresholds corresponding to two connectivity index values defining three connectivity index intervals. A different method is then selected for each interval so as to optimize the permeability estimation in each cell. The simplest method preserving the result accuracy is chosen.

In this embodiment, the thresholds can be defined empirically or by carrying out the stages as follows:

having a set of cells each comprising a fracture network for which a geometrical description is available;

determining a connectivity index for each cell;

determining a network permeability in each cell by means of a flow simulator;

constructing a permeability curve as a function of the connectivity index; and defining the thresholds as a function of the shape of the curve, so that the permeability follows the same behavior law as a function of the connectivity index within the three intervals defined by the thresholds.

In this embodiment, the set of cells for which a geometrical description is available can be selected by choosing a set of cells obtained from the reservoir discretization, whose indices are distributed over the interval of connectivity indices calculated for all of the cells resulting from the reservoir discretization.

The permeability estimation methods can be selected as follows:

estimating the permeability of the fracture network within the cells whose connectivity index is above the second threshold, by means of an analytical formula;

estimating the permeability of the network within the cells whose connectivity index ranges between the two thresholds, by means of a flow simulator.

In this case, the permeability can be estimated as a function of the value of the connectivity index. It is for example possible to:

estimate the permeability of the fracture network within the cells whose connectivity index is above the second threshold, by means of an analytical formula wherein the network permeability is considered to increase linearly as a function of the connectivity index; and to estimate the permeability of the network within cells whose connectivity index ranges between the two thresholds, by means of a method wherein the network permeability is considered to no longer follow the same relation as above the second threshold.

BRIEF DESCRIPTION OF THE DRAWINGS

Other features and advantages of the method according to the invention will be clear from reading the description hereafter of non-limitative embodiment examples, with reference to the accompanying figures wherein.

DETAILED DESCRIPTION OF THE INVENTION

Figure 1:
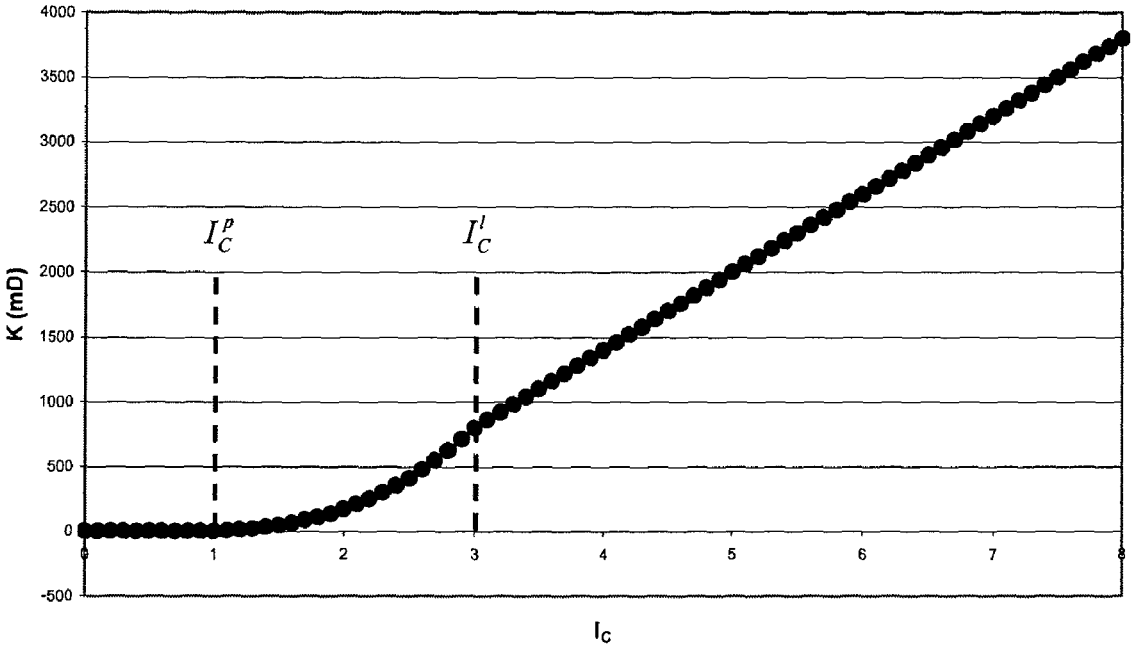
FIG. 1 shows a network permeability curve K as a function of connectivity index $I_C$, from which a percolation threshold $I_C^P$ and a linearity threshold $I_C^l$ are determined ($I_C^P \approx 1$ and $I_C^l \approx 3$)

The method according to the invention allows optimizing the development of a hydrocarbon reservoir, notably when it comprises a fracture network. In particular, the method allows minimizing the time required to determine the fracture network permeabilities while preserving good result accuracy. The method comprises six stages:

1—Discretization of the reservoir into a set of cells

2—Geometrical description of the fracture network

3—Analysis of the fracture network connectivity

4—Determination of the equivalent permeability of a fracture network

5—Simulation of the fluid flows

6—Optimization of the Reservoir Production Conditions

1—Discretization of the Reservoir into a Set of Cells

The petroleum industry has combined for a long time technical measurements with modelling performed in the laboratory and/or by softwares.

Petroleum reservoir modelling thus is an essential technical stage with a view to reservoir exploration or development. The goal of such modelling is to provide a description of the reservoir via its sedimentary architecture and/or its petrophysical properties.

These modellings are based on a representation of the reservoir as a set of cells. Each cell represents a given volume of the reservoir. The cells in their entirety make up a discrete representation of the reservoir.

2—Geometrical Description of the Natural Fracture Network

The geosciences specialist carries out a characterization of the geometry of the natural fracture network: he or she elaborates a geometrical description of the fracture network, in each cell, by means of relevant geometrical attributes.

This geometrical description requires a series of measurements taken in the field by the geologist. These measurements allow characterizing the fracture network so as to lead to a description of the network in form of a set of N fracture families, characterized by geometrical attributes.

In the description that follows, for clarity reasons, the two-dimensional situation of a fracture network of N families contained in a layer is considered, without however the possibility of extending the range of application of the invention to three-dimensional situations of multilayer reservoirs and/or of great thickness in relation to the vertical extent of the fractures being questioned.

In two dimensions, the geometrical attributes relative to a family f can be as follows:

a mean angle of orientation, $\theta_f$, in relation to a reference direction and a mean angle of dispersion, $\alpha_f$, of this orientation around mean angle $\theta_f$. These orientation parameters are generally adjusted to a statistical law (such as Fisher's law for example), a mean length, $L_f$, and a dispersion around this mean, and a density, $d_f$, defined as the cumulative fracture length per surface area unit ($m/m^2$).

This geometrical description of the fracture network can also be determined in a probabilistic way. A geometrical description of the fracture network is then established by assigning to each family of fractures f a probability law $\rho_{\theta,f}$ for the orientations in the layer plane in relation to a reference direction, as well as a length probability law $\rho_{l,f}$ and a density $d_f$. Each probability law for parameter p verifies the relation:

$$\int \rho_{p,f}\, dp = 1$$

According to the measurements taken or to the probability laws defined, in each cell of the discrete reservoir representation, a value is assigned to each geometrical attribute describing the fracture network at the scale of this cell.

The following documents describe an example of techniques that can be used to carry out this task: French Patent 2,725,794 and corresponding U.S. Pat. No. 5,661,698, French Patent 2,725,814 and corresponding U.S. Pat. No. 5,798,768, French Patent 2,733,073 and corresponding U.S. Pat. No. 5,659,135.

At the end of this stage, a representation of the reservoir has been constructed in form of a set of cells and each one of these cells has been assigned a set of geometrical attributes characterizing the fracture network within each cell.

For an application to the 3D case, the geometrical attributes allowing a geometrical description of the fracture network to be established are the same parameters as for the 2D case, as well as:

a mean angle of orientation, $\psi_f$, in relation to a reference direction in the vertical plane and a mean angle of dispersion, $\beta_f$, of this orientation around mean angle $\psi_f$. These orientation parameters are generally adjusted to a statistical law, a mean height, $H_f$, and a dispersion around this mean, and a density, $d_f$, defined as the cumulative fracture surface area per volume unit ($m^2/m^3$).

A geometrical description of the fracture network is established by assigning to each family of fractures f a probability law $\rho_{\theta,f}$ for the orientations in the layer plane in relation to a reference direction, a probability law $\rho_{\Psi,f}$ for the orientations in the vertical plane, a length probability law $\rho_{l,f}$, a height probability law $\rho_{H,f}$ and a density $d_f$.

3—Analysis of the Fracture Network Connectivity

With a view to optimizing the development of a reservoir, the geometry of the fracture network, and the role of the fractures in the hydrodynamic behavior of the reservoir are taken into account. To determine this role, one has to define if the fracture network is connected, so that it directly contributes to the flows and transport at the reservoir scale. Knowledge of this connectivity degree is essential for the reservoir engineer in charge of estimating/predicting the reservoir development.

According to the invention, prior to calculating the network permeability in each cell, which is either costly when using a precise method such as a numerical method, or fast but imprecise when using a method such as an analytical method, the connectivity of the fracture network of the cell being considered is evaluated.

In fact, if the fractures of a network, within a cell, are not connected to one another, the network permeability is zero. In the opposite case, if the fractures of a network, within a cell, are all connected, the permeability is high. In fact, a fluid has no difficulty flowing through the cell in the latter case.

To determine the connectivity degree of the fractures of a network within a cell, an index representative of the number of intersections between the fractures of the network is calculated according to the invention. In fact, the more intersections the fractures of a network comprise, the more they are connected.

This index is referred to as connectivity index and it is denoted by $I_C$. The connectivity index $I_C$ is then a parameter depending on the number of intersections between the fractures of the network. It is determined in each cell from the information resulting from the geometrical description.

In general terms, the following formulation can be used to define connectivity index $I_C$:

$$Ic=g_1(d)g_2(\theta,\alpha)g_3(L)$$

with:

$g_1$: a linear function depending on the fracture density of the network, $g_2$: a function depending on the orientation dispersion (□ in the horizontal plane, $g_3$: a linear function depending on the mean length (L) of the fractures, and $g_4$: a function depending on the orientation dispersion (□) in the vertical plane.

These functions can be empirically evaluated. It is also possible to define the connectivity index from the mean values of the geometrical attributes defined above, as follows:

Case of 2 families (i,j) of constant orientations $\theta_i,\theta_j$:

$$Ic_{ij} = \frac{d_i \cdot d_j \cdot L_i \cdot L_j \cdot \sin(|\theta_i - \theta_j|)}{d_i L_j + d_j L_i}$$

Case of a family f whose orientation dispersion is not negligible and defined by a geostatistical law $\rho_{\theta,f}$:

$$Ic_f = d_f \times L_f \times \int_{\theta_1=0}^{2\Pi}\int_{\theta_2>\theta_1}^{2\Pi} \rho_{\theta,f}(\theta_1)\rho_{\theta,f}(\theta_2)|\sin(\theta_1-\theta_2)|d\theta_1 d\theta_2$$

If the laws of statistical distribution of the geometrical parameters of each family f are considered, the following expression for $I_C$ can be used for a case with N families:

$$Ic = \frac{1}{\sum_{k=1}^{N}\frac{d_k}{L_k}}\left(\begin{array}{l}\sum_{i=1}^{N}\left(d_i^2\cdot\int_{\theta_1=0}^{2\Pi}\int_{\theta_2>\theta_1}^{2\Pi}\rho_{\theta,i}(\theta_1)\rho_{\theta,i}(\theta_2)|\sin(\theta_1-\theta_2)|d\theta_1 d\theta_2\right)+\\ \sum_{i=1}^{N}\sum_{j=i+1}^{N} d_i d_j\int_{\theta_1=0}^{2\Pi}\int_{\theta_2=0}^{2\Pi}\rho_{\theta,i}(\theta_1)\rho_{\theta,j}(\theta_2)|\sin(\theta_1-\theta_2)|d\theta_1 d\theta_2\end{array}\right)$$

4—Determination of the Equivalent Permeability of the Fracture Network

In order to determine the hydrodynamic behavior of a reservoir, it is necessary to evaluate a large-scale fracture network permeability. A permeability referred to as equivalent permeability of the fracture network contained in this cell is then calculated in each cell.

There are two methods: a numerical one, costly in calculation resources for large-size reservoirs (many cells), the other analytical, fast but approximate because based on simplifying hypotheses relative to the network geometry for example.

The invention allows the reservoir engineer to optimize as regards cost (time) and quality (accuracy) the fracture permeability calculation.

Calculation of the permeabilities according to the invention is carried out by analyzing first the value of connectivity index $I_C$.

Selection of Cells for which the Permeability has to be Determined

The principle is as follows:

if connectivity index $I_C$ of the cell being considered shows that the fractures are disconnected, the network permeability is considered to be zero at a large scale. Apart from the case of fractures/faults of great extension, the role of the fractures in the large-scale hydrodynamic behavior of the reservoir is negligible (zero network permeability). In this case, it is therefore not necessary to calculate the permeability of the network. This can concern millions of cells in a fractured reservoir model, and a very large number of unnecessary calculations are thus avoided, if connectivity index $I_C$ indicates that the fractures are connected, the network is considered to acquire a large-scale permeability. The hydraulic role of the fractures could become noticeable and they have to be integrated in the reservoir dynamics study.

The threshold value of the connectivity index from which one considers that it is necessary to calculate the permeability can be obtained empirically, or by means of simulations. The person skilled in the art can notably use a flow simulator, which is a software that is well known to specialists, to define this threshold. This threshold is referred to as percolation threshold. It is denoted by $I_C^P$.

Thus, evaluation of the connectivity of the fracture network in each cell allows selection of the reservoir discretization cells for which it is necessary to determine the network permeability by means of a suitable calculation method. The other cells have a zero network permeability value.

Selection of a Method for Determining the Fracture Network Permeability

According to an embodiment, the calculated connectivity index can be exploited further. In fact, establishing a permeability curve as a function of the connectivity index allows defining permeability behaviors that in turn allow defining the most suitable determination technique.

According to a general embodiment, the permeability calculation method is selected by defining connectivity thresholds corresponding to connectivity index values that define connectivity index intervals. A method is selected for each of the intervals.

These thresholds can be defined empirically or, for example, by carrying out the following stages:

i—having a set of cells each comprising a fracture network for which a geometrical description is available;

ii—calculating the connectivity index for each cell;

iii—determining a network permeability in each cell by means of a flow simulator for example;

iv—constructing a permeability curve as a function of the connectivity index; and v—defining the thresholds as a function of the shape of this curve, so that the permeability varies as a function of the connectivity index according to a homogeneous behavior within the three intervals defined by the thresholds.

"Homogeneous behavior" means that, in an interval, the permeability law follows the same behavior law as a function of the connectivity index. The permeability curve as a function of the connectivity index can then be modelled by a single analytical formula (linear law, polynomial, etc.). In other words, in an interval, the network has the same behavior law regarding flow, that is the same permeability law (hydraulic behavior) as a function of the connectivity index.

In practice, the set of cells of stage i can be defined as follows: after calculating the connectivity index for all the cells of the reservoir discretization, a set of cells whose indices are distributed over the connectivity index interval calculated for all the cells of the reservoir is selected.

According to a particular embodiment, two connectivity thresholds defining three connectivity index intervals are defined.

FIG. 1 illustrates such an approach. This figure shows a network permeability curve, K, as a function of connectivity index $I_C$. It is seen that there is a first threshold. This threshold corresponds to percolation threshold $I_C^P$. It is defined in FIG. 1 by $I_C^P \approx 1$. There is a second threshold, denoted by $I_C^l$, referred to as linearity threshold. It is defined in FIG. 1 by $I_C^l \approx 3$. Beyond this threshold, the curve is a straight line.

These two thresholds define three intervals in which the permeability varies according to a homogeneous behavior as a function of the connectivity index: below $I_C^P$, the permeability is constant (zero), and above $I_C^l$ it increases linearly. Between the two thresholds, the permeability evolves as a function of the connectivity index according to a single non-linear relation.

The connectivity index calculated for each cell of the fractured field model is then used as follows:

$I_C \leqq I_C^P$: $K(I_C)=0$ $I_C \geqq I_C^l$: in this interval, the permeability of the fracture network increases linearly as a function of connectivity index ($I_C$) or of the fracture density (d). It is then possible to use a calculation method allowing the permeability to be determined from an analytical formula. The following formula can for example be defined:

$$K(I_C)=a \cdot I_C+b$$

Coefficients a and b can be determined by a simple linear regression.

$I_C^P \leqq I_C \leqq I_C^l$: in this transition interval, permeability K of the network evolves according to a certain function g depending on connectivity index ($I_C$) or on fracture density (d):

$$K(I_C)=g(I_C)$$

Function g is a function distinct from the linear function defined in interval $I_C \geqq I_C^l$. It is fixed for a given network type, that is for networks whose density only varies (with a number N of families, fixed fracture lengths and orientations for each family).

In this case, a numerical fracture permeability calculation method allows obtaining a precise permeability value. Such a method is described in the following documents: French Patent 2,757,947 and corresponding U.S. Pat. No. 6,023,656.

However, an alternative to the numerical method can be selected so as to increase the permeability calculation rapidity. It uses an approximation such as an analytical formula giving the permeability evolution as a function of the connectivity index.

In conclusion, evaluation of the fracture network connectivity in each cell allows selection of a permeability determination method suited to the requirements in each cell (that is a reliable method on the one hand, fast and economical as regards calculating time on the other hand). It allows at the same time defining three regions of the field (or set of cells) each having a homogeneous fracture permeability behavior.

5—Simulation of the Fluid Flows

At this stage, the reservoir engineer has a discretized representation (set of cells) of the hydrocarbon reservoir from which hydrocarbons are to be extracted. This representation contains information on the fracture network permeability, that is a permeability value is associated with each cell.

The reservoir engineer chooses a production process, for example waterflooding, for which the optimum implementation scenario remains to be specified for the field considered. The definition of an optimum waterflooding scenario consists for example in setting the number and the location (position and spacing) of the injector and producer wells in order to best take account of the impact of the fractures on the progression of the fluids within the reservoir.

According to the scenario selected and to the fracture network permeabilities, it is then possible to simulate the expected hydrocarbon production by means of a tool well known to specialists: a flow simulator. Such a software allows stimulating fluid flows within reservoirs.

6—Optimization of the Reservoir Production Conditions

The scenario allowing to obtain an optimum reservoir production can be selected by selecting various scenarios characterized for example by various respective sites for the injector and producer wells and by simulating the hydrocarbon production for each one according to stage 5. Reservoir development is thus optimized by implementing in the field the production scenario thus selected.

Application Example

Figure 2:
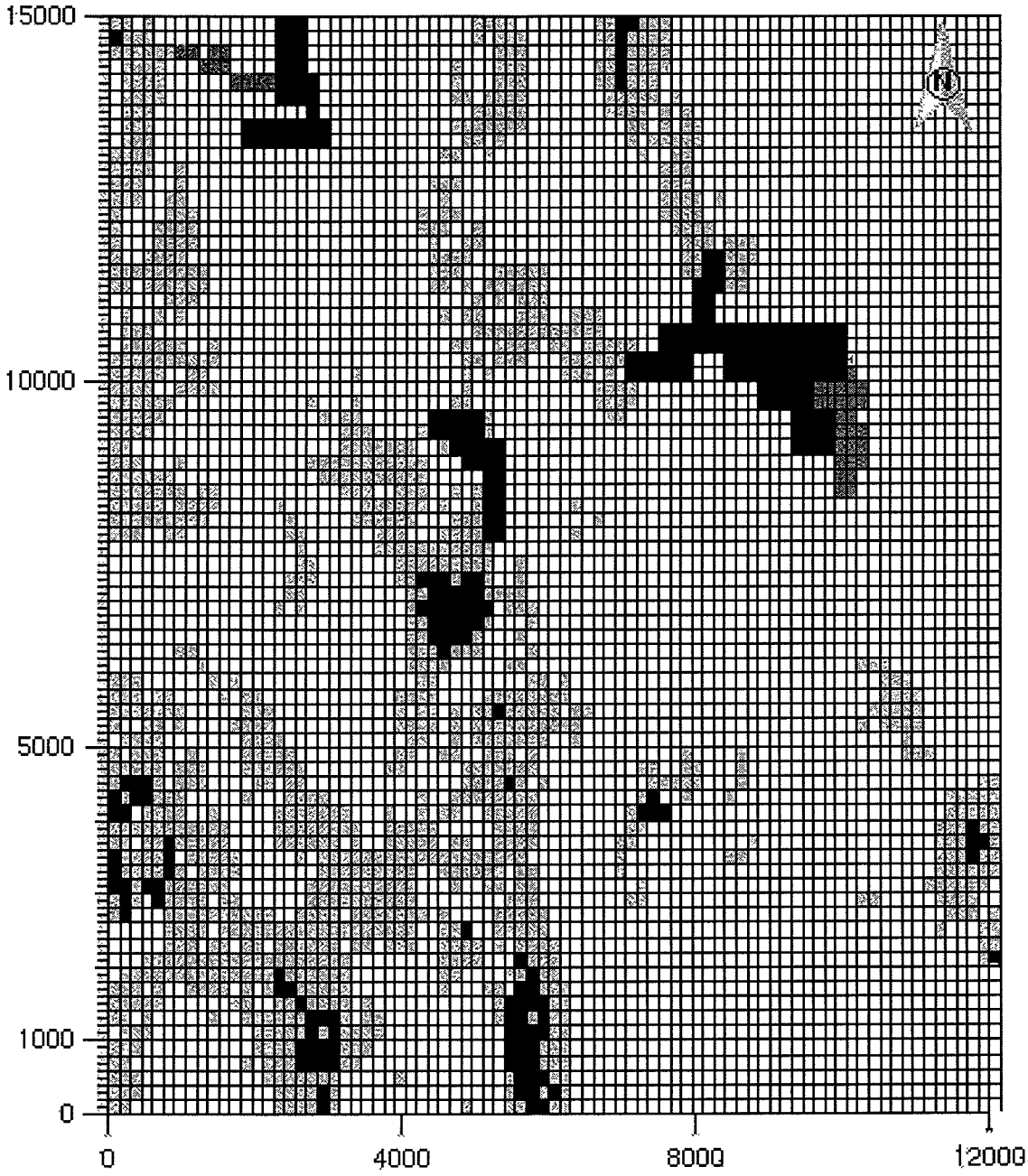
FIG. 2 illustrates the discretization in two dimensions of a reservoir into a set of cells and it indicates the cells for which the permeability is not calculated (zone 1, in white), the cells for which the permeability is calculated by means of a flow simulator (zone 2, in grey) and the cells for which the permeability is calculated by means of a linear formula (zone 3, in black).

A hydrocarbon reservoir comprising a fracture network is discretized. FIG. 2 illustrates the result of this two-dimensional gridding.

A geometrical description of the fracture network in each cell is elaborated using information resulting from geological analyses and measurements.

A connectivity index defined for example by the following formula (formula based on the mean attributes of each fracture family) is determined within each cell:

$$Ic = \frac{\sum_{i=1}^{N}\sum_{j=i+1}^{N} d_i \cdot d_j \cdot |\sin(\theta_i - \theta_j)|}{\sum_{i=1}^{N} \frac{d_i}{L_i}}$$

This index defines the mean number of intersections between fractures within each cell.

The existence of two percolation $I_c^P \approx 1$ and linearity $I_C^l \approx 3$ thresholds for classifying the cells according to their connectivity index and for thus defining three field zones (or regions) respectively characterized by values of this index below $I_C^P$, above $I_C^l$ and ranging between $I_C^P$ and $I_C^l$ is take into account. This zone definition determines the choice of the fracture permeability calculation method.

FIG. 2 illustrates, in two dimensions, the cells of the reservoir representation for which the permeability is not calculated (zone 1 where $I_C \leqq I_C^P$, in white), the cells for which the permeability is calculated by means of a flow simulator (zone 2 where $I_C^P \leqq I_C \leqq I_C^l$, in grey), and the cells for which the permeability is calculated by means of a linear formula (zone 3 where $I_C \geqq I_C^l$, in black).

In zone 1, the permeability is not calculated. Invaluable calculating time is thus saved. In zone 3, a linear calculation giving the same precision as a numerical simulation is carried out. In zone 2, a flow simulator is used to obtain a high precision.

A production process, waterflooding for example, is then selected. The method of implementing this process for the field being considered still remains to be specified, more particularly if this field is fractured. Various implementation scenarios, different from one another in the position of the wells for example, are then defined and compared on the basis of quantitative production/recovery criteria for the fluids in place. Evaluation (forecasting) of these production criteria requires a field simulator which is able to reproduce (simulate) each scenario. In the case of fractured reservoirs, the permeabilities of the fracture network at the simulator resolution scale (reservoir scale) are essential basic data for carrying out these simulations and determining information to guarantee the reliability of the production estimates.

Advantages

The invention allows estimation of the large-scale permeability (scale of the drainage radius of a well or of the interwell space for example) of these fractures, in a fast and accurate manner.

It is then possible to predict the hydrodynamic behavior (flow rate, pressure, etc.) in response to exterior stresses imposed via wells during hydrocarbon production.

Engineers in charge of reservoir development therefore have a tool allowing them to rapidly evaluate the performance of various production scenarios and thus to select the one that optimizes the development from the viewpoint of the criteria selected by the operator, ensuring an optimum hydrocarbon production.

The invention thus finds an industrial application in the development of underground reservoirs comprising a fracture network. It can be a hydrocarbon reservoir whose production is to be optimized, or a gas storage reservoir for example, whose injection or storage conditions are to be optimized.

The invention claimed is:

1. A method for optimizing development of a reservoir including a fracture network, wherein the reservoir is discretized into a set of grid cells and a geometrical description of the fracture network of each cell, comprising:

determining, within each cell, a connectivity degree of fractures of the fracture network by calculating a connectivity index depending at least on a number of intersections between fractures by use of the geometrical description;

estimating permeability of cells of the fracture network with the connectivity index above a threshold;

assigning a fixed permeability value within other cells with the connectivity index below the threshold to limit a number of permeability estimations;

selecting with a computer a production scenario for optimizing development of the reservoir by using a flow simulator implemented as software in a computer to simulate fluid flows in the reservoir as a function of the permeability of the fracture network; and optimizing development of the reservoir by implementing in the reservoir the selected production scenario; and wherein the permeability of the fracture network is estimated by using for each cell a method of estimation of the permeability of the fracture network as a function of value of the connectivity index and the method of estimation is selected by defining first and second connectivity thresholds corresponding to two connectivity index values defining three connectivity index intervals, and a different method is selected for each of the intervals to optimize estimation of the permeability value in each cell.

2. A method as claimed in claim 1, wherein the first and second connectivity thresholds are defined empirically.

3. A method as claimed in claim 1 wherein the first and second connectivity thresholds are defined by carrying out the following steps:

providing a set of cells each comprising a fracture network for which a geometrical description is available;

determining a connectivity index for each cell;

determining a network permeability in each cell with a flow simulator;

constructing a permeability curve as a function of the connectivity index; and defining the first and second connectivity thresholds as a function of shape of the curve so that the permeability follows an identical behavior law as a function of the connectivity index within the three intervals defined by the first and second connectivity thresholds.

4. A method as claimed in claim 3, wherein the set of cells is determined by selecting a set of cells resulting from reservoir discretization with indices distributed in an interval of connectivity indices calculated for all cells resulting from the discretization of the reservoir.

5. A method as claimed in claim 1, comprising:

estimating permeability of the fracture network within cells with a connectivity index which is above the second threshold by using an analytical formula; and estimating permeability of the network within the cells with a connectivity index which ranges between the first and second connectivity thresholds by using a flow simulator.

6. A method as claimed in claim 2, comprising:

estimating permeability of the fracture network within cells with a connectivity index which is above the second threshold by using an analytical formula; and estimating permeability of the network within the cells with a connectivity index which ranges between the first and second connectivity thresholds by using a flow simulator.

7. A method as claimed in claim 3, comprising:

estimating permeability of the fracture network within cells with a connectivity index which is above the second threshold by using an analytical formula; and estimating permeability of the network within the cells with a connectivity index which ranges between the first and second connectivity thresholds by using a flow simulator.

8. A method as claimed in claim 4 comprising:

estimating permeability of the fracture network within cells with a connectivity index which is above the second threshold by using an analytical formula; and estimating permeability of the network within the cells with a connectivity index which ranges between the first and second connectivity thresholds by using a flow simulator.

9. A method as claimed in claim 5, wherein the permeability are estimated as a function of the value of the connectivity index values.

10. A method as claimed in claim 6, wherein the permeabilities are estimated as a function of the connectivity index values.

11. A method as claimed in claim 7, wherein the permeabilities are estimated as a function of the connectivity index values.

12. A method as claimed in claim 8, wherein the permeabilities are estimated as a function of the connectivity index values.

13. A method as claimed in claim 9, comprising:

(a) estimating permeability of the fracture network within the cells with a connectivity index which is above the second connectivity threshold by using an analytical formula with network permeability increasing linearly as a function of the connectivity index; and (b) estimating permeability of the network within cells with a connectivity index ranging between the first and second connectivity thresholds using a method in which network permeability does not follow a relation identical to the estimation of permeability in step (a).

14. A method as claimed in claim 10, comprising:

(a) estimating permeability of the fracture network within the cells with a connectivity index which is above the second connectivity threshold by using an analytical formula with network permeability increasing linearly as a function of the connectivity index; and (b) estimating permeability of the network within cells with a connectivity index ranging between the first and second connectivity thresholds using a method in which network permeability does not follow a relation identical to the estimation permeability in step (a).

15. A method as claimed in claim 11, comprising:

(a) estimating permeability of the fracture network within the cells with a connectivity index which is above the second connectivity threshold by using an analytical formula with network permeability increasing linearly as a function of the connectivity index; and (b) estimating permeability of the network within cells with a connectivity index ranging between the first and second connectivity thresholds using a method in which network permeability does not follow a relation identical to the estimation of permeability in step (a).

16. A method as claimed in claim 12, comprising:

(a) estimating permeability of the fracture network within the cells with a connectivity index which is above the second connectivity threshold by using an analytical formula with network permeability increasing linearly as a function of the connectivity index; and (b) estimating permeability of the network within cells with a connectivity index ranging between the first and second connectivity thresholds using a method in which network permeability does not follow a relation identical to the estimation of permeability in step (a).

* * * * *